US007686173B2

(12) United States Patent
Robinson et al.

(10) Patent No.: US 7,686,173 B2
(45) Date of Patent: Mar. 30, 2010

(54) MODULAR SHELVING SYSTEM

(75) Inventors: Larry Robinson, Taylorsville, MS (US); J. Derrick Dry, Laurel, MS (US); Bart Majors, Hattiesburg, MS (US)

(73) Assignee: Solar Group, Inc., Taylorsville, MS (US)

( * ) Notice: Subject to any disclaimer, the term of this patent is extended or adjusted under 35 U.S.C. 154(b) by 823 days.

(21) Appl. No.: 11/048,838

(22) Filed: Feb. 2, 2005

(65) Prior Publication Data

US 2006/0169659 A1 Aug. 3, 2006

(51) Int. Cl.
*A47B 43/00* (2006.01)

(52) U.S. Cl. ..... 211/190; 211/187

(58) Field of Classification Search ..... 211/187, 211/188, 190, 191, 192, 207; 108/193, 180, 108/109, 106, 107; 312/257.1, 107, 108, 312/111, 263

See application file for complete search history.

(56) References Cited

U.S. PATENT DOCUMENTS

| | | | | | |
|---|---|---|---|---|---|
| 2,788,902 | A * | 4/1957 | Nowicki | 108/157.13 |
| 2,808,788 | A * | 10/1957 | Stough | 410/89 |
| 3,807,572 | A * | 4/1974 | Luvara et al. | 211/10 |
| 3,848,844 | A * | 11/1974 | Barrett | 248/245 |
| 4,382,518 | A * | 5/1983 | Bondoux | 211/192 |
| 4,469,231 | A * | 9/1984 | Hehn | 211/11 |
| 4,703,853 | A | 11/1987 | Byrns | |
| 4,724,968 | A * | 2/1988 | Wombacher | 211/59.3 |
| 4,934,858 | A * | 6/1990 | Beaulieu | 403/174 |
| 4,995,323 | A | 2/1991 | Kellems et al. | |
| 5,368,380 | A * | 11/1994 | Mottmiller et al. | 312/263 |
| 5,372,265 | A * | 12/1994 | Monch | 211/187 |
| 5,588,726 | A * | 12/1996 | Lee | 312/263 |
| 5,735,411 | A * | 4/1998 | Flamme et al. | 211/26 |
| 5,803,561 | A * | 9/1998 | Puehlhorn | 312/264 |
| 5,893,617 | A * | 4/1999 | Lee | 312/263 |
| 6,126,022 | A * | 10/2000 | Merkel | 211/135 |
| 6,193,340 | B1 * | 2/2001 | Schenker et al. | 312/265.5 |
| 6,227,385 | B1 * | 5/2001 | Nickerson | 211/59.3 |
| 6,248,441 | B1 | 6/2001 | Anderson et al. | |
| 6,273,281 | B1 * | 8/2001 | Berglund | 211/187 |
| 6,348,173 | B1 | 2/2002 | Anderson | |
| 6,412,688 | B1 | 7/2002 | Tucker et al. | |
| 6,422,386 | B1 | 7/2002 | Wiese et al. | |
| 6,569,276 | B2 | 5/2003 | Anderson et al. | |
| 6,659,276 | B2 | 12/2003 | Anderson et al. | |
| 6,675,979 | B2 * | 1/2004 | Taylor | 211/186 |
| 6,695,418 | B2 | 2/2004 | Skov et al. | |
| 2002/0063100 | A1 * | 5/2002 | Kwang | 211/40 |
| 2007/0044692 | A1 * | 3/2007 | Zimmer | 108/180 |

* cited by examiner

*Primary Examiner*—Jennifer E. Novosad
(74) *Attorney, Agent, or Firm*—Eckert Seamans Cherin & Mellott, LLC; Philip E. Levy, Esq.

(57) ABSTRACT

A modular shelving system including a number of separate, selectively inter-connectable pieces, and methods of assembling such a shelving system. The selectively inter-connectable pieces of the shelving system include vertical supports columns, cap shelves for attachment thereto, hanging rods, and adjustable shelves and drawers and selectively placeable support elements for supporting same.

9 Claims, 15 Drawing Sheets

MODULAR SHELVING SYSTEM

BACKGROUND OF THE INVENTION

1. Field of the Invention

This invention relates to a shelving system and, more particularly, to an easily assembled and installed modular shelving system that may be customized by the user to suit the user's particular needs.

2. Description of the Prior Art

It is often desirable or even necessary to provide shelving for storage of items in various places such as a closet, a storage room, a workroom, a utility room, an office or a garage. Many different types of shelving systems are known in the art, including various metal, wood or plastic systems that may be shipped and/or sold to the user in an unassembled state and subsequently assembled and installed by the user in a desired location.

For example, one prior art metal shelving unit consists of a number of metal shelves and four elongated, vertical corner pieces. Such units are sold in pieces, and require the user to attach the corners of the metal shelves to the corner pieces by a nut and bolt assembly or the like. This type of shelving system requires a large number of individual pieces and various tools for assembly. Also, assembly configurations are limited in this type of a system, and thus there is limited opportunity for the user to customize the system to meet his or her needs.

Other prior art shelving systems include modular shelving systems constructed in a number of pieces from a material such as wood and/or metal. The separate pieces of the system are designed to be mounted together using hardware such as screws, latches and/or nut and bolt assemblies. Again, this type of shelving system requires a large number of pieces and various tools for assembly. In addition, such systems are often difficult, time consuming and confusing to assemble, leading to frustration and wasted time on the part of the user. Further, once assembled, such systems are difficult and time consuming to disassemble and modify, which may be required as the needs of the user change.

Still another type of prior art shelving system often utilized in closets consists of a number of shelves made of a plurality of welded, coated wires. The shelves are typically mounted to a wall by the user using screws and the like, often making installation difficult and time consuming, particularly to a user who may not be particularly handy. Such systems, while lightweight, do not present a sturdy appearance due to the gaps that exist between the wire supports. In addition, items that are smaller than the gaps between the small, one-eighth inch diameter wire supports may not be stored with this type of system as those items will fall through the gaps.

There is therefore a need for a modular shelving system that is quick and easy to assemble and disassemble with very limited or no use of separate tools. There is further a need for such a modular shelving system that may be customized by a user to meet certain needs, and that may be easily and readily reconfigured and adjusted as needs change.

SUMMARY OF THE INVENTION

The present invention relates to a customizable modular shelving system including a number of separate pieces that is easy to assemble and disassemble with very limited or no use of separate tools. As a result, the shelving system may be easily and readily reconfigured and adjusted as the needs of the user change.

One aspect of the present invention relates to a shelving system, and a method of assembling same, including a vertical support column having one or more slots provided in the upper portion thereof, and a shelf having one or more connectors protruding from a first end thereof. The slots in the vertical support column have a first shape and the connectors each have an enlarged portion having a second shape, wherein the first shape and the second shape are generally complementary to one another. The enlarged portion of each of the connectors is disposed in a respective one of the slots. The shelving system may further include a second vertical support column having slots having the same first shape provided in the upper portion thereof, wherein the shelf has connectors having an enlarged portion having the same second shape protruding from a second end thereof. The connectors on the second end of the shelf are, in this embodiment, disposed in the slots provided in the second vertical support column. The slots and connectors may be generally T-shaped.

The upper portion of the vertical support column may also have one or more detents, and the first end of the shelf may have one or more protruding tabs, wherein the one or more protruding tabs are received and held in place by the one or more detents. In addition, the upper portion of the vertical support column may also have a recess, and the first end of the shelf may have a protruding member, wherein the protruding member is received by and supported on a bottom edge of the recess. Further, the upper portion of the vertical support column may have a horizontal support ledge extending therefrom, and the bottom edge of the first end of the shelf may rest on and be supported by the support ledge.

The shelf in this aspect of the invention may have a generally planar top surface and one or more valances extending downwardly from and generally perpendicular to the top surface. In addition, the lower portion of the vertical support column may have a plurality of feet extending therefrom. Preferably, the plurality of feet may include a front foot and a back foot, with the front foot being slightly longer than the back foot to cause the vertical support column to be angled backwardly against a wall in the location where the shelving system is placed.

In another embodiment, the shelving system further includes a second vertical support column having one or more tabs extending from the upper portion thereof, and the upper portion of the first vertical support column has one or more recesses provided therein. The first vertical support column is a bottom vertical support column and the second vertical support column is a top vertical support column. In this embodiment, each of the tabs is disposed in a respective one of the recesses to hold the second vertical support column in place. The lower portion of the vertical support column may also include a recessed portion that provides clearance for a baseboard affixed to a wall in a location where the shelving system is placed. Similarly, the vertical support column may include a recessed portion located between the upper portion and the lower portion thereof that provides clearance for a chair rail affixed to a wall in a location where the shelving system is placed. In addition, the lower portion of the vertical support column may have one or more recessed portions adapted to receive a fastening element for fastening the vertical support column in place.

Another aspect of the present invention relates to a shelving system including a vertical support column having a slot provided in the first side thereof and an elongated rod having an enlarged end that is disposed in the slot. Preferably, the enlarged end of the rod is flared, and the rod is elongated and tubular. Also, the slot is preferably angled rearwardly and downwardly. In one particular embodiment, the slot is angled downwardly at an angle of between approximately 15 degrees and approximately 45 degrees from the horizontal axis of the vertical support column. The shelving system according to this aspect of the invention may further include a second vertical support column having a second slot provided therein, wherein the rod has a second enlarged end opposite the first enlarged end that is disposed in the second slot. In addition, a wall plate having another slot may be mounted on a wall adjacent to the shelving system, and an enlarged end of the rod may be received in the slot provided on the wall plate.

Yet another aspect of the present invention relates to a shelving system including a vertical support column having a plurality of mounting openings, and a support element removeably attached to the vertical support column through one of the mounting openings. The support element includes a receiving portion that fits over and receives a portion of the vertical support column that defines a bottom outer edge of the mounting opening. The support element preferably includes either one or two elongated tongues adjacent to the receiving portion. Also, the receiving portion may have one or more barbs extending from an inner surface thereof that are adapted to be disposed in an indentation provided in the vertical support column below the mounting opening. In one particular embodiment, the shelving system further includes a shelf having an elongated groove along a first side thereof, wherein the elongated tongue is disposed in the elongated groove such that the shelf is supported by the support element. In another particular embodiment, the shelving system further includes a drawer having an elongated groove along a first side thereof, wherein the elongated tongue is disposed in the elongated groove such that the drawer is slideably supported by the support element.

The shelving system according to this aspect of the invention may further include a second vertical support column having a plurality of second mounting openings and a second support element removeably attached to the second vertical support column through one of the second mounting openings that is generally aligned with the mounting opening of the first vertical support column to which the first support element is attached. The second support element includes a second receiving portion that fits over and receives a portion of the second vertical support column that defines a bottom outer edge of the second mounting opening. The second support element preferably includes a second elongated tongue adjacent to the second receiving portion for supporting a shelf or a drawer.

Yet another aspect of the present invention relates to a shelving system including a first vertical support column having an upper portion having a first configuration, a lower portion, and a plurality of first openings therethrough, and a second vertical support column attached to the first vertical support column having an upper portion having a second configuration, a lower portion, and a plurality of second openings therethrough. The first configuration and said second configuration are generally complementary to one another such that the upper portion of the first vertical support column mates with the lower portion of the second vertical support column. The first configuration may comprise one or more recesses provided in the upper portion of the first vertical support column and the second configuration may comprise one or more tabs extending from the lower portion of the second vertical support column, wherein each of the tabs is disposed in a respective one of the recesses.

It is an object of this invention to provide a shelving system that is easily and quickly assembled and disassembled, offering time saving advantages not found in similar products.

It is a further object of this invention to provide a shelving system that may be assembled with limited or no use of separate tools.

It is a further object of this invention to provide a shelving system that is made of an attractive material such as molded plastic.

It is a further object of this invention to provide a shelving system that is economical.

It is a further object of this invention to provide a method of assembling a shelving system that enables the pieces of the shelving system to be packed and shipped in simple and compact manner.

It is a further object of this invention to provide a shelving system that may be easily and readily reconfigured and adjusted as the needs of the user change.

It is a further object of this invention to provide a shelving system that is usable in a wide variety of residential, commercial and industrial locations.

DESCRIPTION OF THE DRAWINGS

These and other advantages of the present invention will become readily apparent upon consideration of the following detailed description and attached drawings, wherein.

DETAILED DESCRIPTION OF THE PREFERRED EMBODIMENTS

Figure 1:
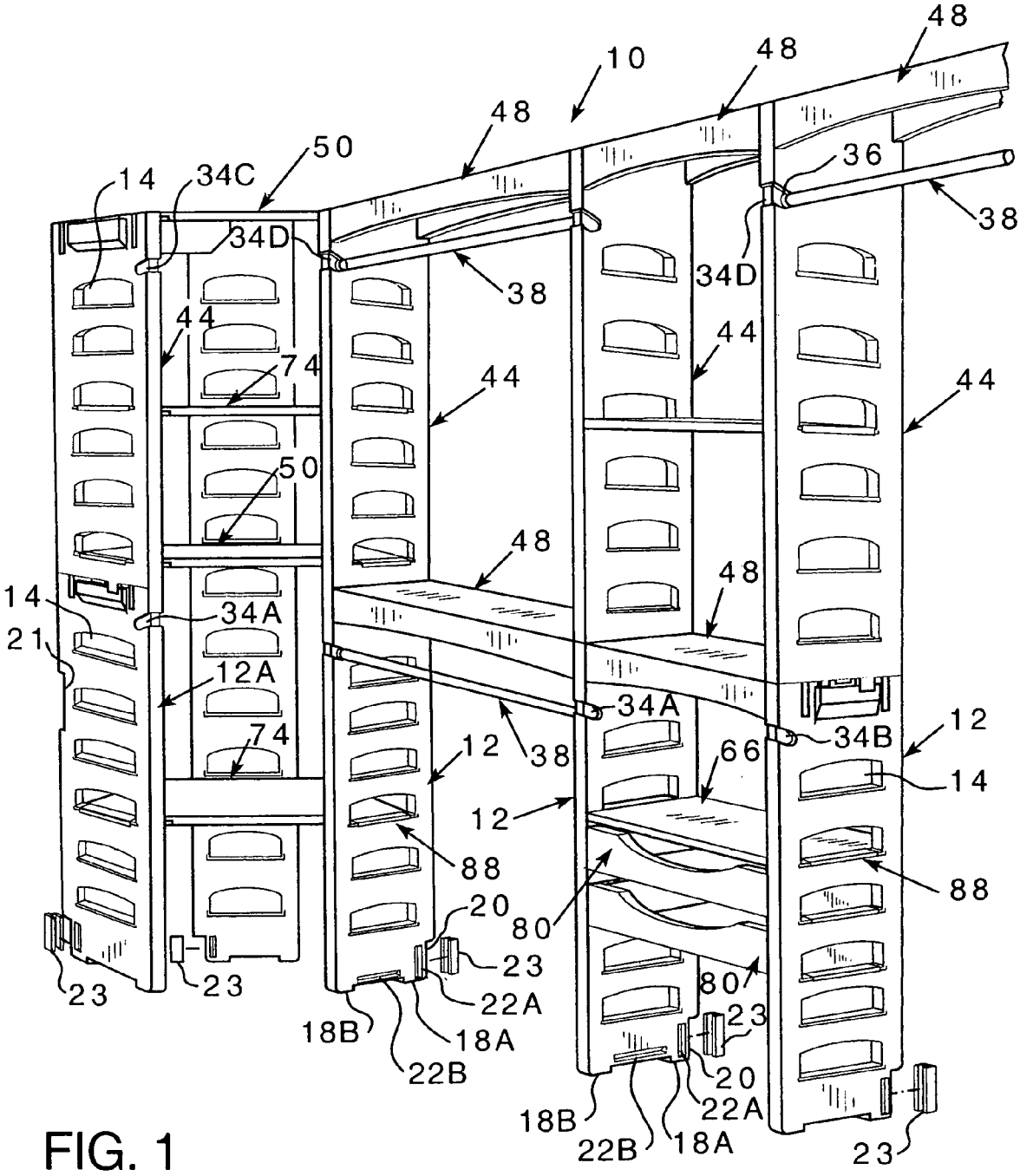
FIG. 1 is an isometric view of an exemplary configuration of a shelving system according to the present invention.

The present invention relates to a modular shelving system consisting of a number of separate pieces that may be selectively assembled together in a number of different configurations depending on the particular wants and needs of the user. FIG. 1 is an isometric view of one possible configuration of a shelving system 10 according to the present invention which includes a number of shelves, drawers and rods for holding and storing items such as clothing and the like in an area such as a closet. It should be appreciated that the configuration shown in FIG. 1 is exemplary only, and, as will be understood from the following description, many other configurations of shelving system 10 may be created depending on the particular wants and needs of the user.

As can be seen in FIG. 1, shelving system 10 consists of a number of different modular pieces that may be quickly and easily fit together by a user. Each of the pieces of shelving system 10 is described in detail herein, as is the manner in which the pieces may be selectively fit together in a customizable fashion by the user.

Figure 2A:
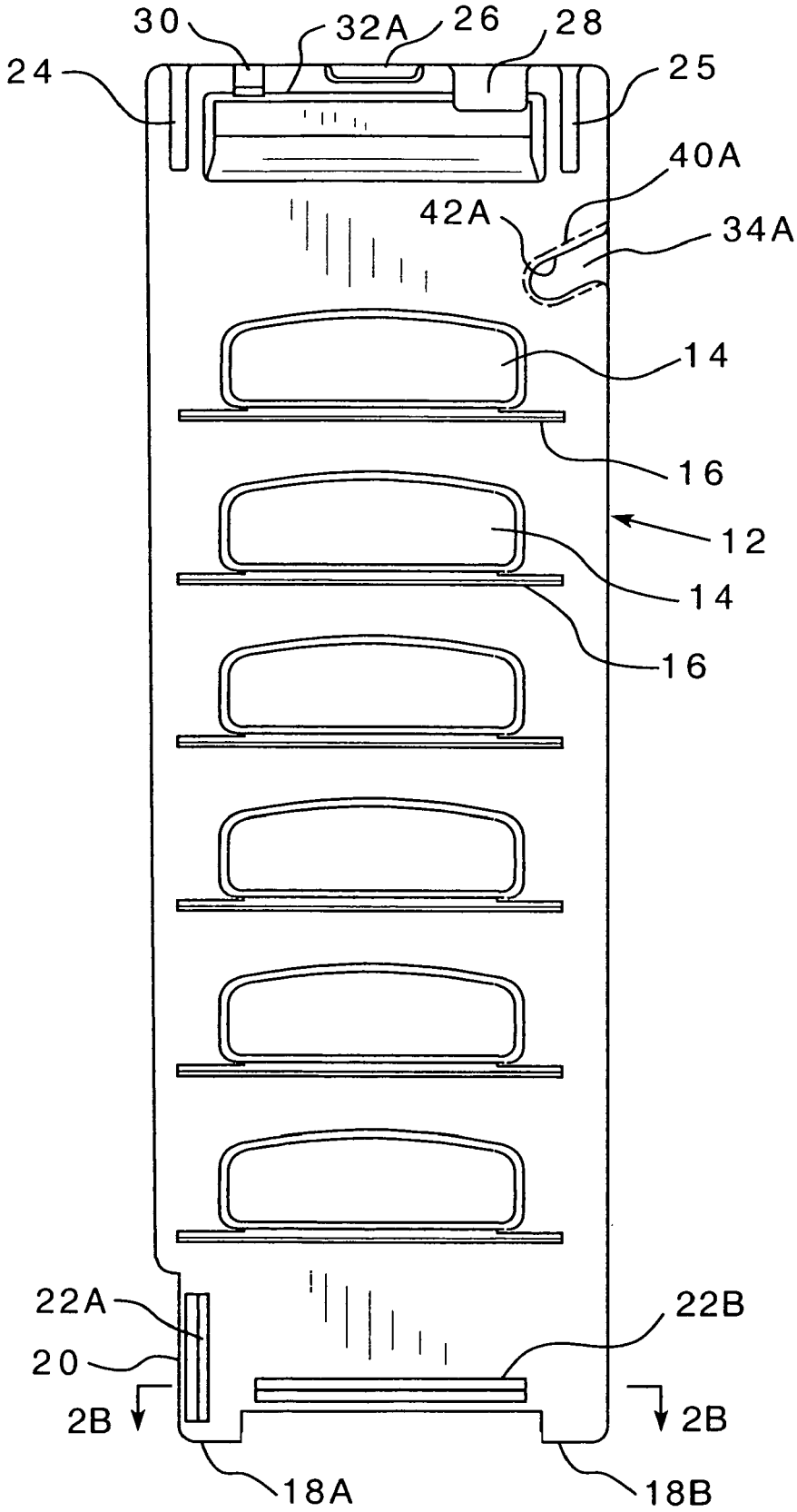
FIG. 2A is a left side view of a lower column forming a part of a shelving system according to the present invention.
Figure 2B:
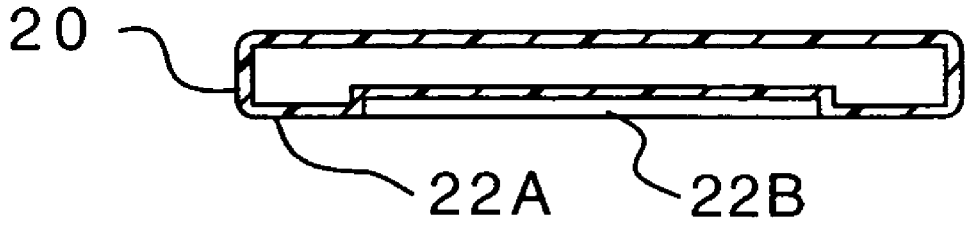
FIG. 2B is a cross-sectional view of the lower column shown in FIG. 2A taken along lines 2B-2B in FIG. 2A.
Figure 2C:
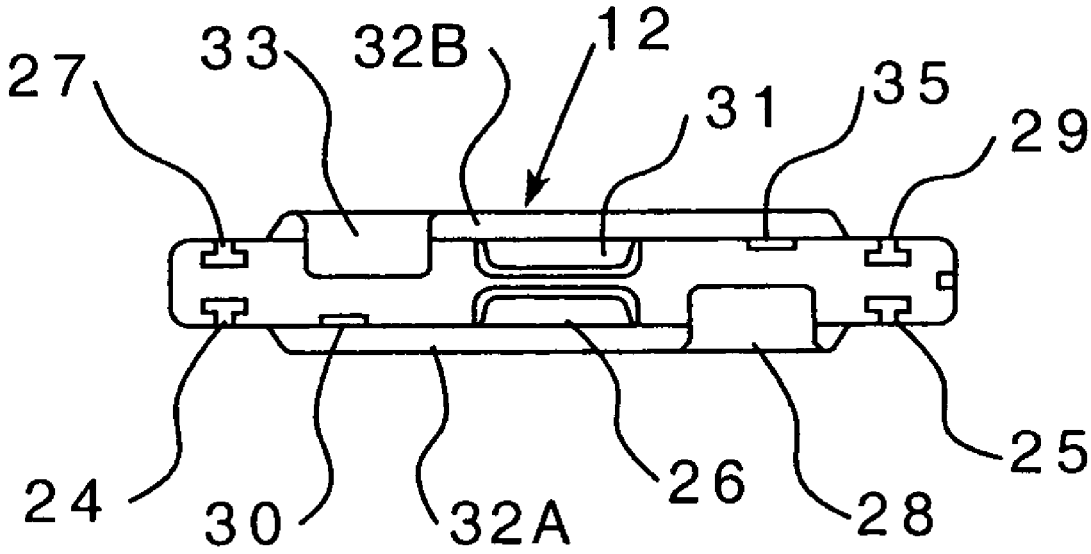
FIG. 2C is a top plan view of the lower column shown in FIG. 2A.

FIGS. 2A and 2C are left side and top plan views, respectively, of a lower column 12 that forms one piece of shelving system 10. FIG. 2B is a cross-sectional view of lower column 12 taken along lines 2B-2B shown in FIG. 2A. Each lower column 12 used in shelving system 10 is an elongated piece that is intended to act as a base for shelving system 10. The length of lower column 12 is preferably in the range of about 36 inches to 48 inches (to allow the shelving system to fit with standard eight inch ceilings), and most preferably in the range of about 40 inches to 46 inches. In one particular embodiment, lower column 12 is approximately 42 inches long. Lower column 12 includes a plurality of mounting openings 14 disposed along the length thereof. As seen in FIG. 1, mounting openings 14 extend entirely through the body of lower column 12. Indentations 16, the purpose of which will be described herein, are provided beneath each mounting hole 14. Lower column 12 includes feet 18A and 18B at its lower portion for contacting the floor in the location where shelving system 10 is to be placed. Preferably, foot 18B is made slightly longer than foot 18A so that lower column 12 will angle slightly backward against a wall in the location where shelving system 10 is assembled. In addition, the lower portion of lower column 12 has a recessed portion 20 that is offset from the remainder of lower column 12. Recessed portion 20 provides a clearance for a baseboard or the like that may be in place at the location where shelving system 10 is placed. As seen in FIG. 1, a spacer 23 may be used when a baseboard is not present. Also, one particular embodiment of lower column 12, shown as lower column 12A in FIG. 1, includes recessed portion 21 which provides clearance for a chair rail or the like that may be present in the location where shelving system 10 is placed. An elongated vertical recess 22A is defined within the lower portion of lower column 12 adjacent to recessed portion 20. Recess 22A is adapted to receive a screw or the like to facilitate the anchoring of lower column 12 to a wall or baseboard. Similarly, an elongated horizontal recess 22B is provided within the lower portion of lower column 12 between feet 18A and 18B. Recess 22B is adapted to receive a screw or the like to facilitate mounting of lower column 12 to, for example, wood floors. Recess 22A and 22B can be seen in cross-section in FIG. 2B.

As seen in FIGS. 2A and 2C, the upper portion of lower column 12 includes four generally T-shaped slots 24, 25, 27 and 29, two of which are provided on the left side of lower column 12 and two of which are provided on the right side of lower column 12. Also provided at the upper portion of lower column 12 on each side thereof are recesses 26 and 31, recesses 28 and 33, detents 30 and 35, and support ledges 32A and 32B, all of which are used in the assembly of shelving system 10. The specific purpose of each of these elements will be described in more detail herein.

A rod pocket 34A is provided on the left (shown in FIG. 2A) side of lower column 12 near the upper portion thereof. A corresponding rod pocket 34B (see FIG. 1) is provided on the right (not shown in FIG. 2A) side of lower column 12. As seen more easily in FIG. 1, each rod pocket 34A and 34B consists of a recess or slot provided in lower column 12 for receiving a flared end 36 of a rod 38 shown in FIGS. 10A-10C and described in greater detail herein. Preferably, the recess or slot extends generally downwardly and rearwardly at an angle of between 15 degrees and 45 degrees, most preferably at 30 degrees. As seen in FIG. 2A, inner edge 40A surrounding recess 34A is provided deeper inside lower column 12 than outer edge 42A. This difference forms the pocket or slot that receives and holds in place the flared end 36 of a rod 38.

Figure 3A:
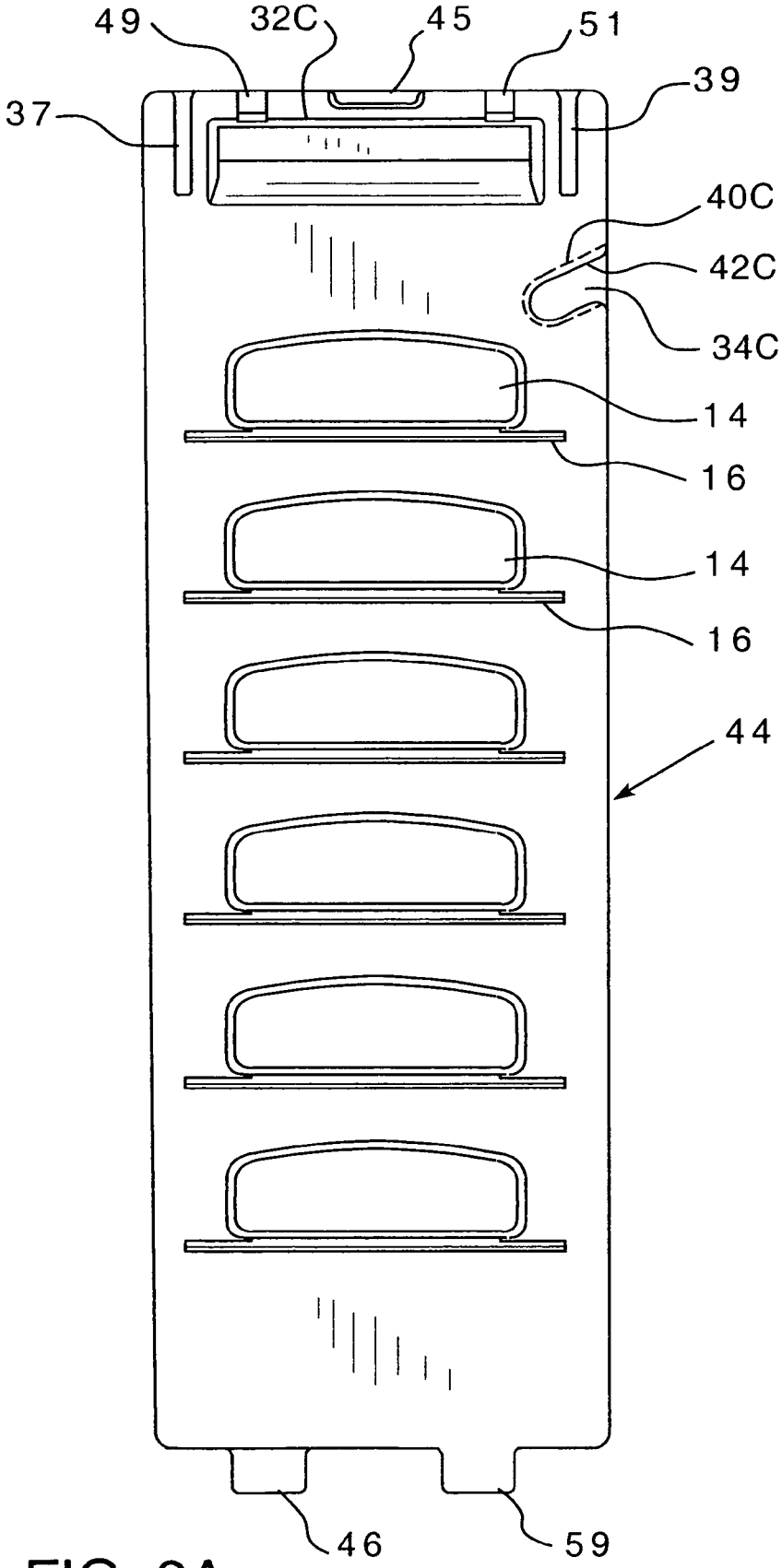
FIG. 3A is a left side view of an upper column forming a part of a shelving system according to the present invention.
Figure 3B:
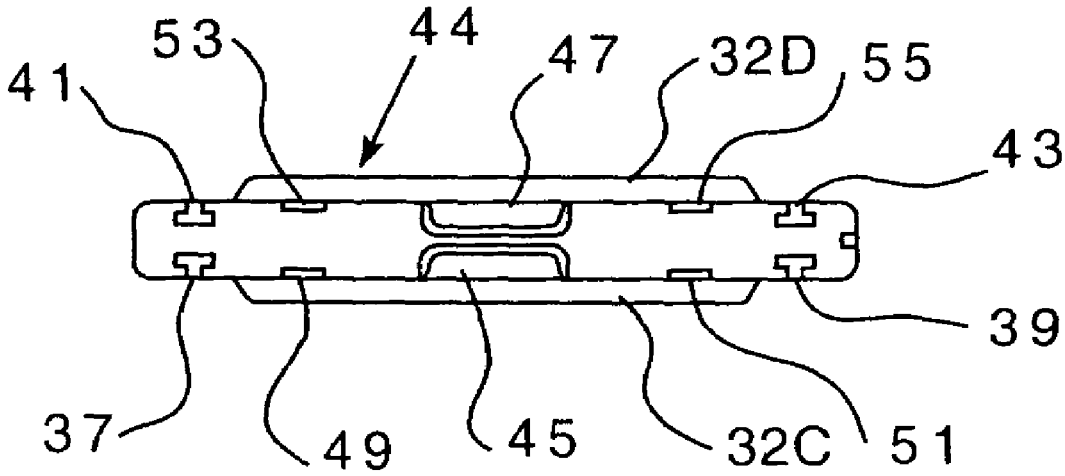
FIG. 3B is a top plan view of the upper column shown in FIG. 3A.
Figure 3C:
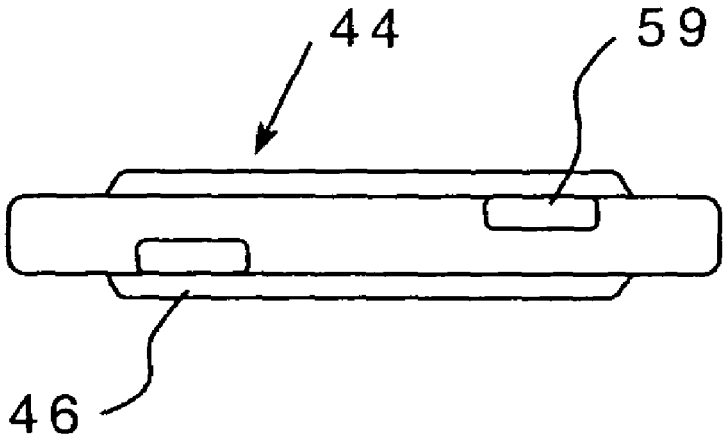
FIG. 3C is a bottom plan view of the upper column shown in FIG. 3A.
Figure 8:
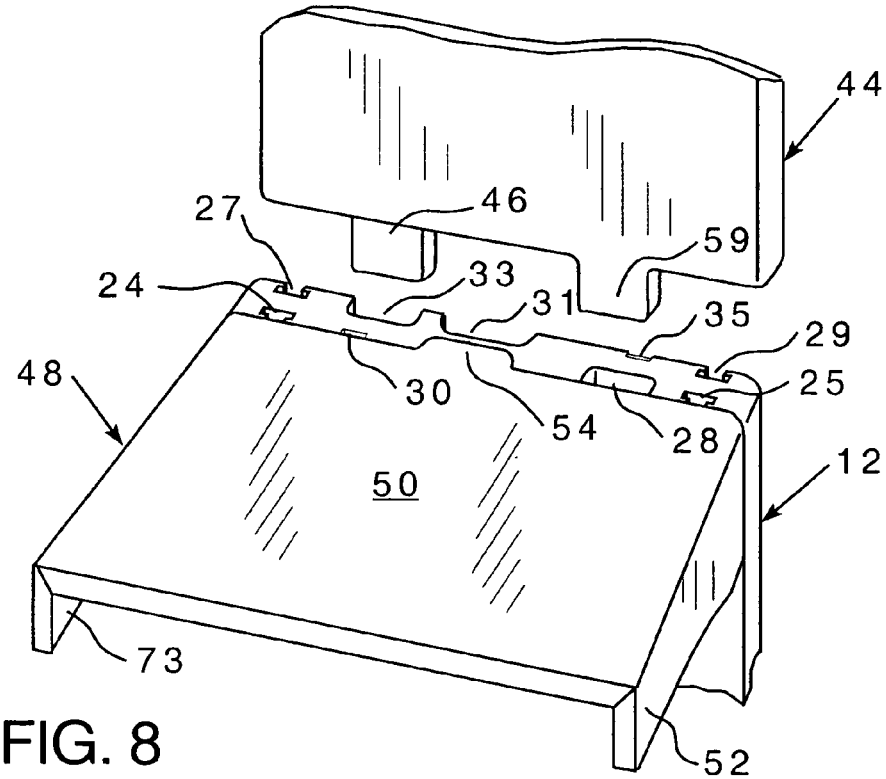
FIG. 8 is a partial isometric view showing the upper column shown in FIG. 3A being mounted on top of the lower column shown in FIG. 2A.
Figure 11A:
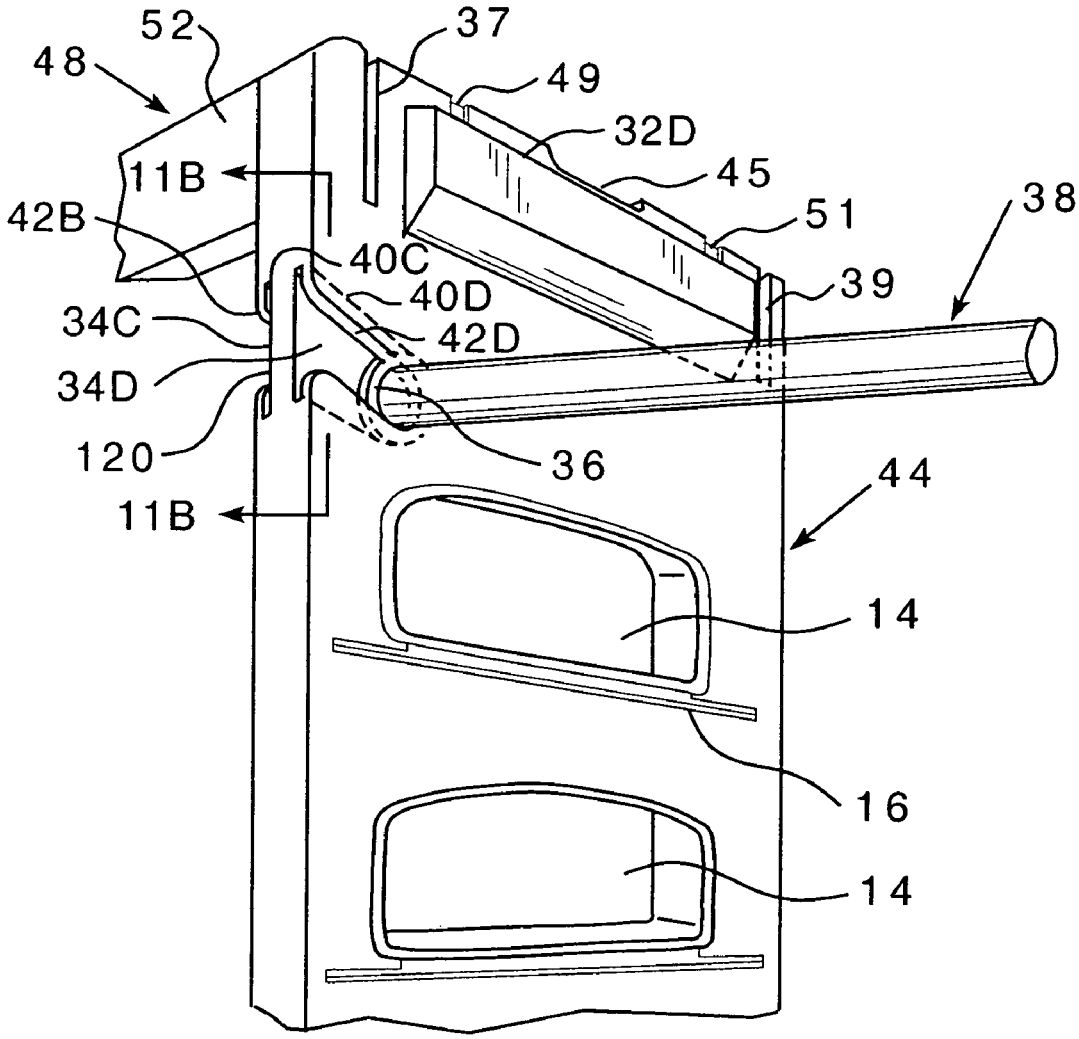
FIG. 11A is a partial isometric view showing the rod shown in FIGS. 10A-10C inserted into the rod pocket of the upper column shown in FIG. 3A.

FIGS. 3A, 3B and 3C show left side, top plan and bottom plan views, respectively, of an upper column 44 that forms another piece of shelving system 10. Upper column 44 is similar to lower column 12, and includes generally T-shaped slots 37, 39, 41 and 43, recesses 45 and 47, detents 49, 51, 53 and 55, and support ledges 32C and 32D. Upper column 44 also includes rod pockets 34C and 34D (not shown in FIG. 3A) for receiving the flared end of a rod 38. Another view of rod pockets 34C and 34D (which are similar in shape to rod pockets 34A and 34B) is provided in FIG. 11B, which is a cross-sectional view of rod pockets 34A and 34B taken along lines 11A-11B in FIG. 11A. One significant difference between the two is that upper column 44 includes tabs 46 and 59 extending from the lower portion thereof which are, as seen in FIG. 8, adapted to be received in recesses 28 and 33, respectively, of lower column 12 during the assembly of shelving system 10. Also, as seen in FIG. 3B, unlike lower column 12, upper column 44 does not include recesses similar to recesses 28 and 33, and includes four detents 49, 51, 53 and 55 rather than two detents 30 and 35.

Figure 4:
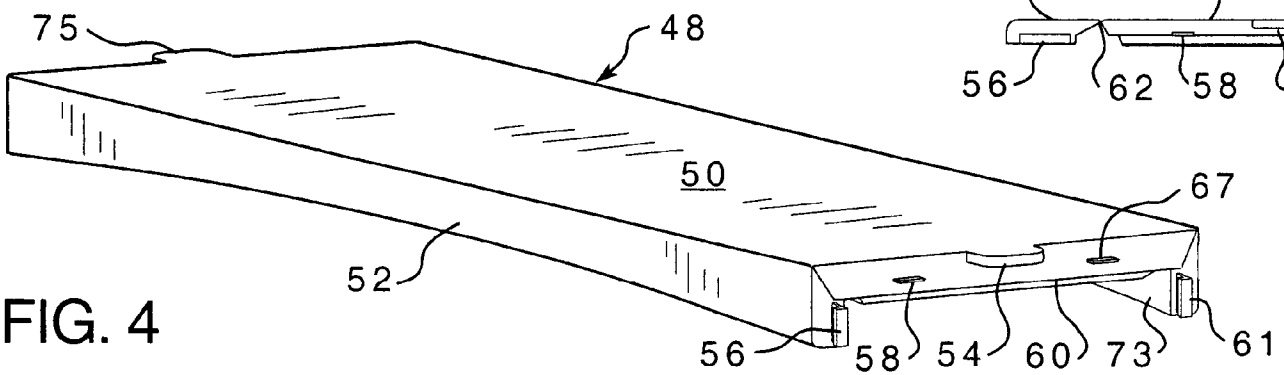
FIG. 4 is an isometric view of a cap shelf forming a part of a shelving system according to the present invention.

FIG. 4 is an isometric view of a cap shelf 48 that forms another piece of shelving system 10. As seen in FIG. 1, cap shelves 48 are intended to be attached to the ends of two lower columns 12 or upper columns 44 to provide a surface on which to place and store items. Cap shelf 48 includes a base 50 having a generally planar top surface and front and back valences 52 and 73, respectively. The base 50 is generally perpendicular to the valences 52 and 73, and, as a result, the valences 52 and 73 strengthen cap shelf 48 for load support. Cap shelf 48 may be provided with integral ribs which act as a stiffener. As seen in FIG. 4, each end of cap shelf 48 includes a protruding member 54 and 75, respectively, a pair of protruding generally T-shaped connectors 56 and 61 and 63 and 65, respectively, (see FIG. 5), and a pair of protruding tabs 58 and 67 and 69 and 71, respectively (see FIG. 5).

Figure 7:
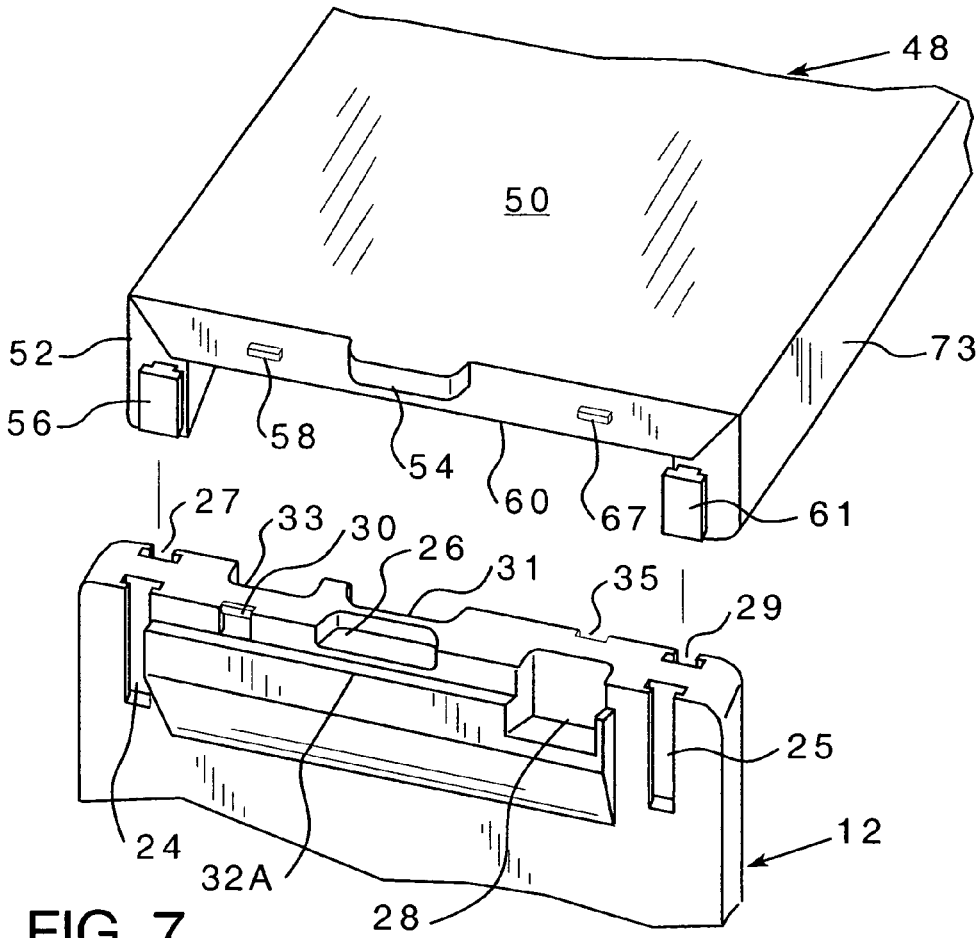
FIG. 7 is a partial isometric view showing the cap shelf shown in FIG. 4 being attached to the lower column shown in FIG. 2A.

During assembly of shelving system 10, each end of cap shelf 48 is adapted to be attached to a respective lower column 12 or upper column 44 in the manner shown in FIG. 7. In particular, each T-shaped connector 56, 61, 63, 65 is adapted to be received and disposed in a corresponding T-shaped slot 24, 25, 27, 29 (lower column 12) or 37, 39, 41, 43 (upper column 44), as the case may be. In addition, each protruding member 54, 75 is adapted to be received in a corresponding recess 26, 31 (lower column 12) or 45, 47 (upper column 44) and supported on a bottom edge thereof, and two or more of tabs 58, 67, 69, 71 are adapted to be received and held by corresponding detents 30, 35 (lower column 12), or 49, 51, 53, 55 (upper column 44), preferably producing an audible snapping sound when located in place. Further, a bottom edge 60 of each end of cap shelf 48 is adapted to rest on and be supported by a corresponding support ledge 32A, 32B, 32C, 32D.

As will be appreciated, when a cap shelf 48 is attached at each end to a lower column 12, the three pieces together, as can bee seen in FIG. 1, will be able to stand on their own. Preferably, cap shelf 48 is provided in two or more sizes, ranging from 12 inches to 48 inches to provide flexibility in the manner in which shelving system 10 is assembled. In one specific embodiment of the present invention, a 21 inch long and a 42 inch long cap shelf 48 are provided.

As will also be appreciated, alternatively shaped connectors and complimentary shaped slots may be substituted for T-shaped connectors 56, 61, 63 and 65 and T-shaped slots 24, 25, 27, 29, 37, 39, 41 and 43 without departing from the scope of the present invention. For example, connectors having an enlarged portion having a generally triangular, cylindrical, spherical, or other shape may be provided on cap shelf 48 and/or corner cap shelf 64 (FIG. 9), with complimentary shaped slots for receipt thereof being provided on lower column 12 and upper column 44.

Figure 5:
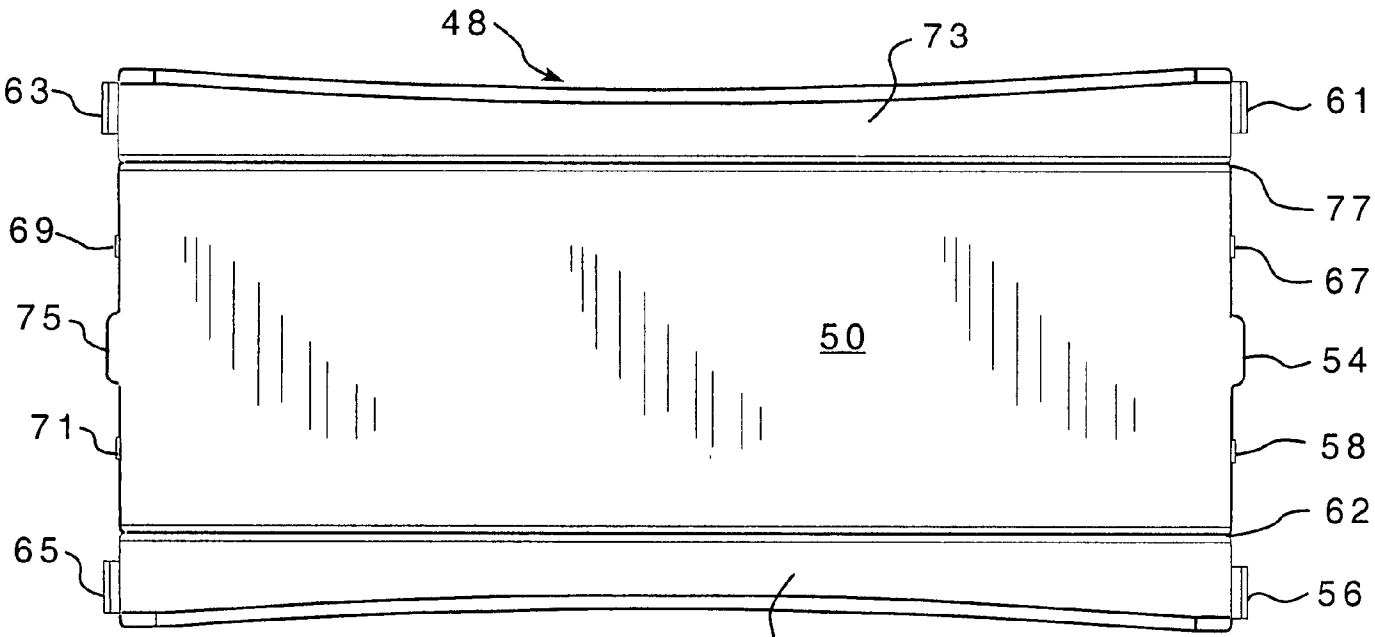
FIGS. 5 and 6 are top plan and front elevational views, respectively, of the cap shelf shown in FIG. 4 in the state in which it is packaged and shipped to a user.
Figure 6:
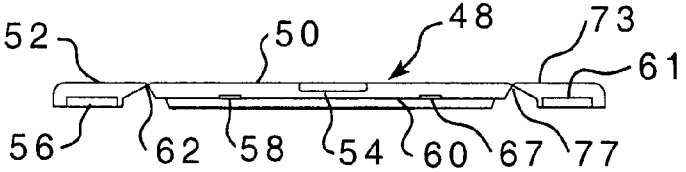

According to one aspect of the invention, cap shelves 48 are blow-molded from a plastic material such as HDPE (high density polyethylene) generally planar configuration as shown in FIGS. 5 and 6. The wall thickness of a cap shelf 48 that is manufactured in this manner may preferably range from about one-sixteenth of an inch to one-eighth of an inch, and most preferably range from about 0.075 inches to 0.100 inches. This planar configuration, in which the top surface of base 50 and the top surfaces of valences 52 and 73 are generally parallel to one another, allows cap shelves 48 to take up less space, which makes the packing and shipping of cap shelves 48 easier and more compact. In this embodiment, each valence 52, 73 is connected to base 50 by a living hinge 62, 77. As is known in the art, a "living hinge" refers to a hinge in a plastics material article formed from the plastics material itself. When it is time to assemble shelving system 10, each cap shelf 48 is folded at living hinges 62 and 77, causing the top surface of base 50 to be generally perpendicular to the top surface of each valence 52, 73. Valences 52 and 73 may be held in this folded down position when attached to a lower column 12 or an upper column 44 as shown in FIG. 7, after which time they will be held down as a result of T-shaped connectors 56, 61, 63 and 65 being inserted into corresponding T-shaped slots 24, 25, 27, 29, 37, 39, 41 or 43, as the case may be. Alternatively, cap shelf 48 may be provided with a known snap connection mechanism, such as a protruding member on each of valences 52 and 73 and corresponding detents on base 50, that will hold valences 52 and 73 in the folded down position. As will be appreciated, any of the parts of shelving system 10 described herein may also be made from a plastic material as described above using a technique such as blow-molding. In addition, other parts, such as the separate pieces used to make drawer 80 described herein (FIG. 14) may be manufactured in a generally planar configuration with one or more "living hinges" for subsequent assembly by a user.

Once a cap shelf 48 is attached to a lower column 12, upper column 44 may be attached to lower column 12 in the manner shown in FIG. 8. Specifically, tabs 46 and 59 of upper column 44 may be inserted into corresponding recesses 28 and 33, which, in some situations, will be bounded on one end or both ends by a cap shelf 48. As will be appreciated, this step will result in upper column 44 being stacked on top of lower column 12, as can be seen in several places in FIG. 1. Once a number of upper columns 44 have been so stacked on top of respective lower columns 12 in a desired configuration, cap shelves 48 may be attached to upper columns 44 as desired.

Figure 9:
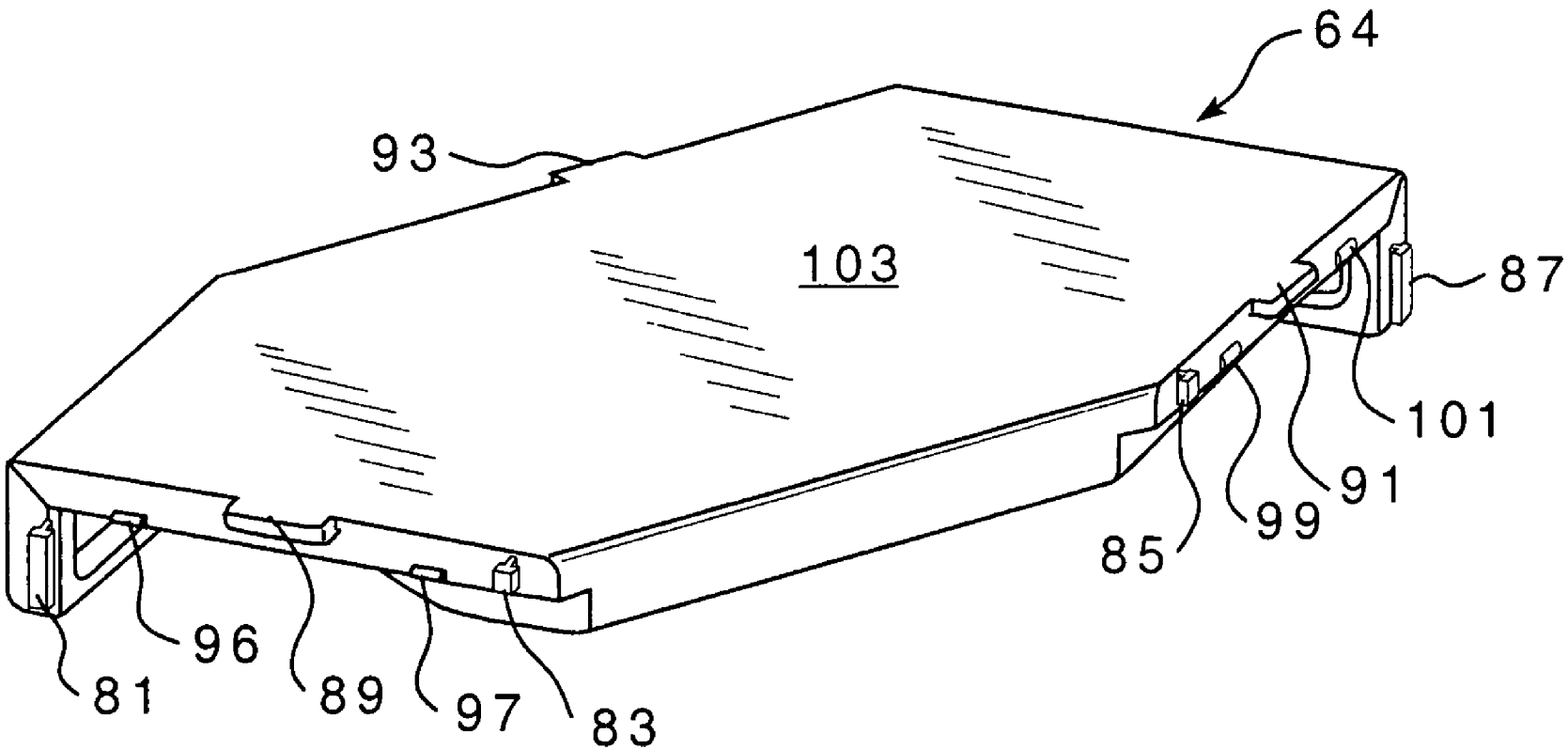
FIG. 9 is an isometric view of a corner cap shelf forming a part of a shelving system according to the present invention.

FIG. 9 shows an isometric view of corner cap shelf 64 that forms yet another piece of shelving system 10. Corner cap shelf 64 is similar to cap shelf 48 in that it is adapted to be attached to and to be located between respective lower columns 12 or upper columns 44. As such, it includes protruding members 89, 91 and 93, T-shaped connectors 81, 83, 85 and 87 and tabs 96, 97, 99 and 101. Corner cap shelf 64 has a six-sided shape that is adapted to fit into a corner of a room or other space such that the respective lower columns 12 or upper columns 44 to which it is attached are generally perpendicular to one another, as can be seen in FIG. 1.

Figure 10A:
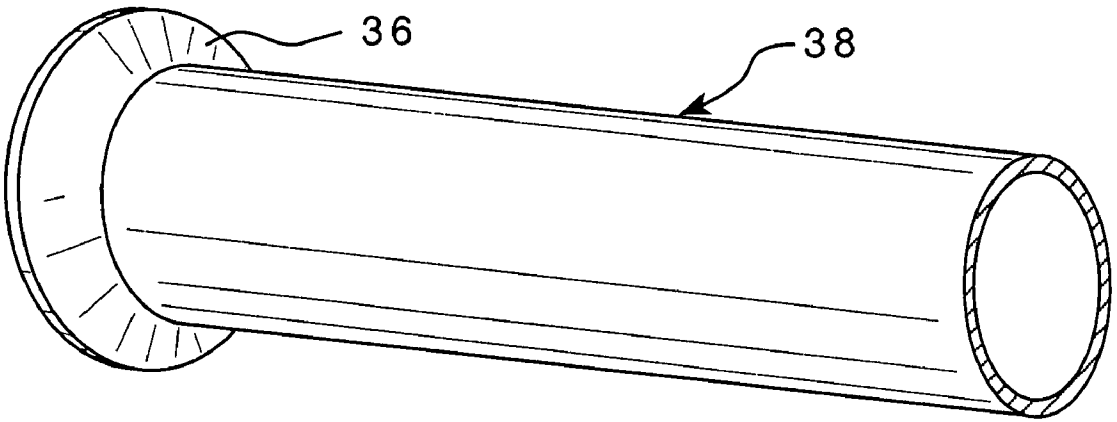
FIGS. 10A, 10B and 10C are isometric, end and side views, respectively, of a rod forming a part of a shelving system according to the present invention.
Figure 10C:
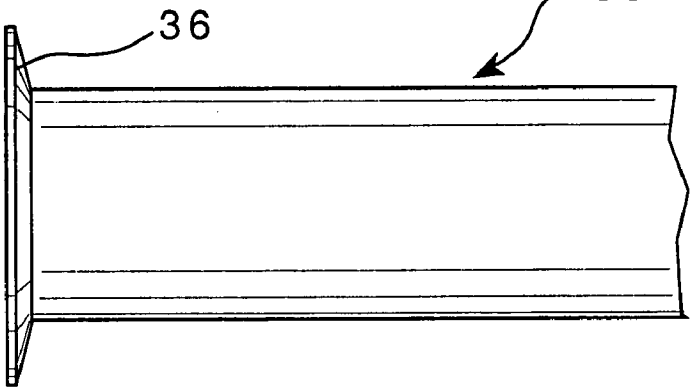
Figure 10B:
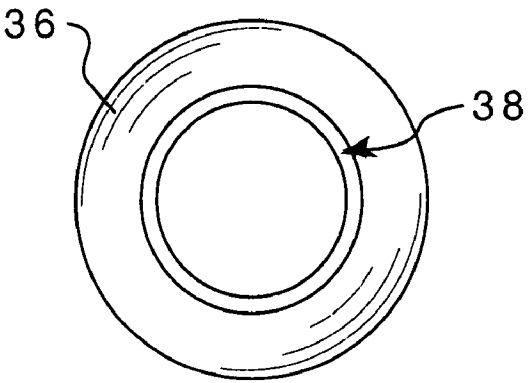
Figure 11B:
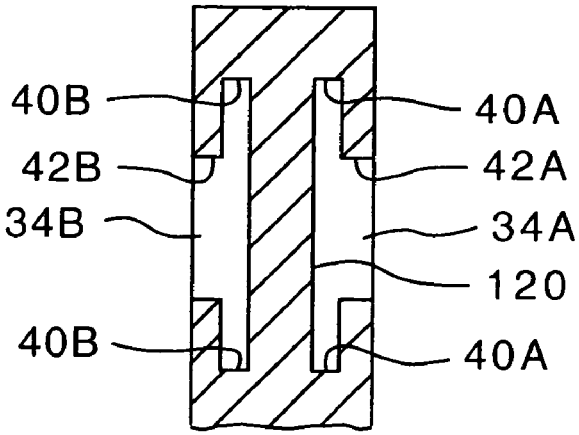
FIG. 11B is a cross-sectional view taken along lines 11B-11B shown in FIG. 11A.

FIGS. 10A, 10B and 10C are isometric, end and side views, respectively, of rod 38 that forms another piece of shelving system 10. Rod 38 includes flared end 36 at each end thereof. Preferably, to reduce weight and expense, rod 38 is hollow and tubular. Rod 38 may be made of a plated or painted metal, such as CRS (cold rolled steel), a plastic material such as TPR, or any other suitable material. One or more rods 38 may be selectively inserted into rod pockets 34A and 34B provided in lower columns 12 or rod pockets 34C and 34D provided in upper columns 44 in the manner shown in FIG. 11A as desired. FIG. 11B is a cross-sectional view of upper column 44 taken along lines 11B-11B in FIG. 11A which depicts rod pockets 34C and 34D. As seen in FIG. 11B, rod pockets 34C and 34D are separated by a portion 120 of upper column 44. As will be appreciated, rod pockets 34A and 34B of lower column 12 have a similar configuration. As will also be appreciated, items such as clothing may be hung on rods 38.

Figure 12:
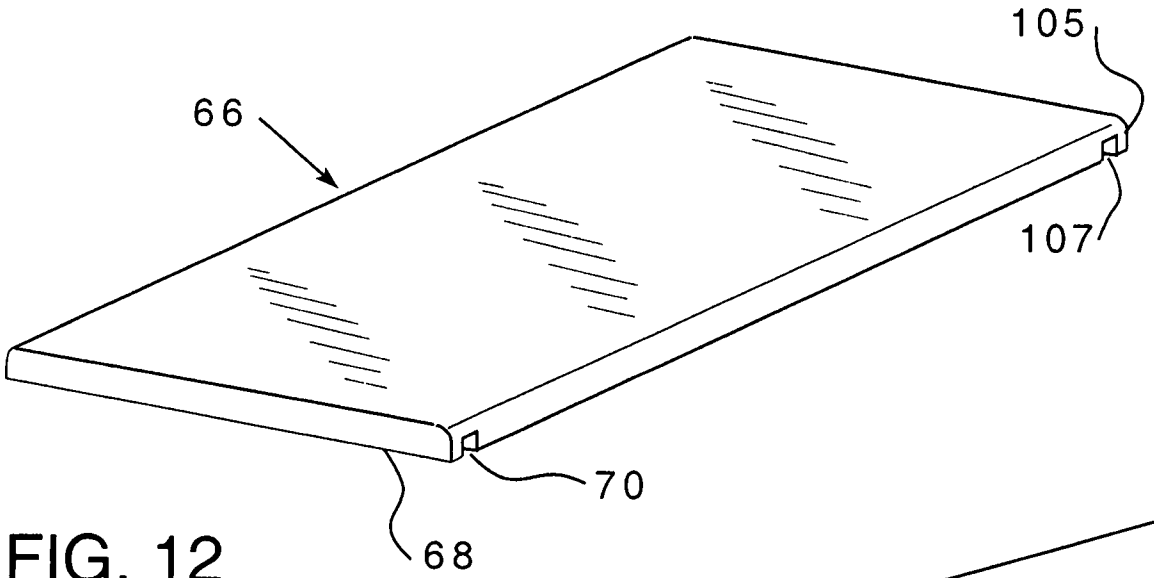
FIG. 12 is an isometric view of an adjustable shelf forming a part of a shelving system according to the present invention.

FIG. 12 is an isometric view of adjustable shelf 66 that forms yet another piece of shelving system 10. Adjustable shelf 66 includes a generally flat surface 121 onto which items may be placed for storage. Preferably, adjustable shelf 66 is provided in two or more sizes, ranging from 12 inches to 48 inches to provide flexibility in the manner in which shelving system 10 is assembled. In one specific embodiment of the invention, a 21 inch and a 42 inch width adjustable shelf 66 are provided. Adjustable shelf 66 also includes an outer lip 68, 105 and a groove 70, 107 on each lateral end thereof, the purpose of which is described herein. Adjustable shelf 66 may be selectively placed between any two lower columns 12 or upper columns 44 as shown in FIG. 1 in a manner to be described herein.

Figure 13:
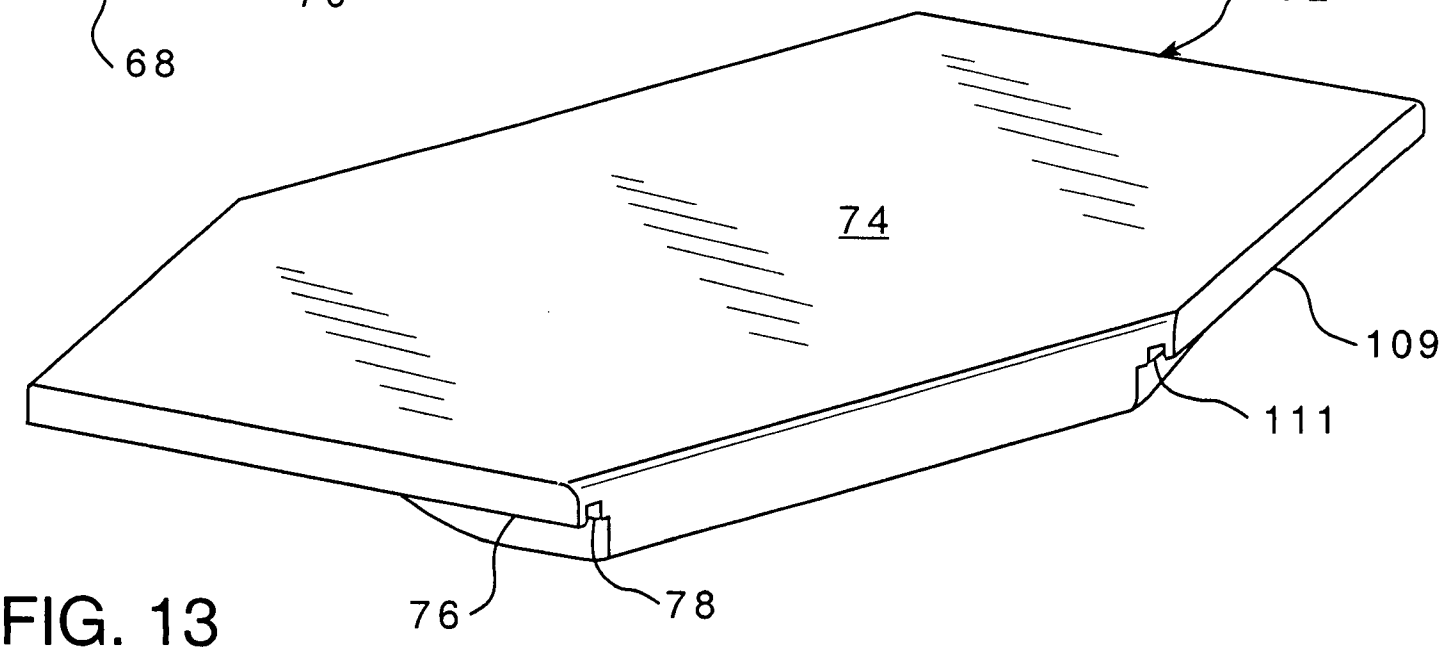
FIG. 13 is an isometric view of a corner adjustable shelf forming a part of a shelving system according to the present invention.

FIG. 13 is an isometric view of corner adjustable shelf 72 that forms another piece of shelving system 10. Corner adjustable shelf 72 is similar to adjustable shelf 66, except that it is intended to be selectively placed between two lower columns 12 or two upper columns 44 as shown in FIG. 1 in a corner of a room or other space. As such, corner adjustable shelf 72 has a six-sided shape similar to corner cap shelf 64.

Like adjustable shelf 66, corner adjustable shelf 72 includes generally flat surface 74, lips 76 and 109 and grooves 78 and 111.

Figure 14:
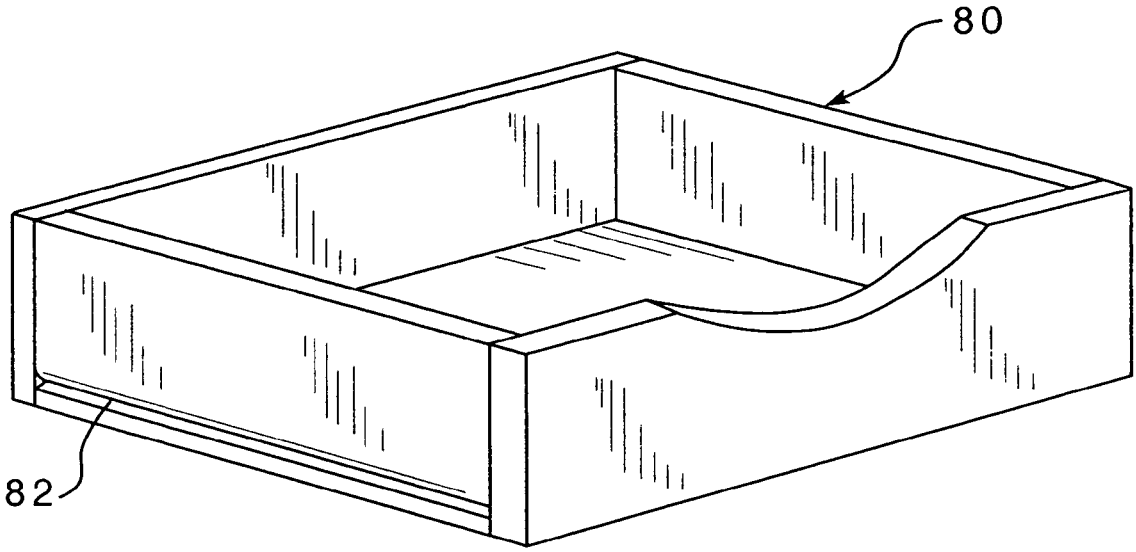
FIG. 14 is an isometric view of a drawer forming a part of a shelving system according to the present invention.

FIG. 14 is an isometric view of a drawer 80 that forms still another piece of shelving system 10. Drawer 80 may be used for receiving items for storage. Like adjustable shelf 66, drawer 80 may be selectively placed between any two lower columns 12 or upper columns 44. Drawer 80 is preferably provided in two or more sizes ranging from 12 inches to 48 inches wide and 5 inches to 10 inches deep (any depth may, however, be used as needed) to provide flexibility in the manner of assembly of shelving system 10. In one specific embodiment of the present invention, 21 inch and 42 inch width drawers 80 are provided. Drawer 80 includes a lip 82 and a groove 84 (see FIG. 18A) on each end thereof. Drawer 80 may be shipped to a user in a number of separate pieces (e.g., front, back. And bottom with attached (by a living hinge) right and left sides) for subsequent assembly by the user.

Figure 15:
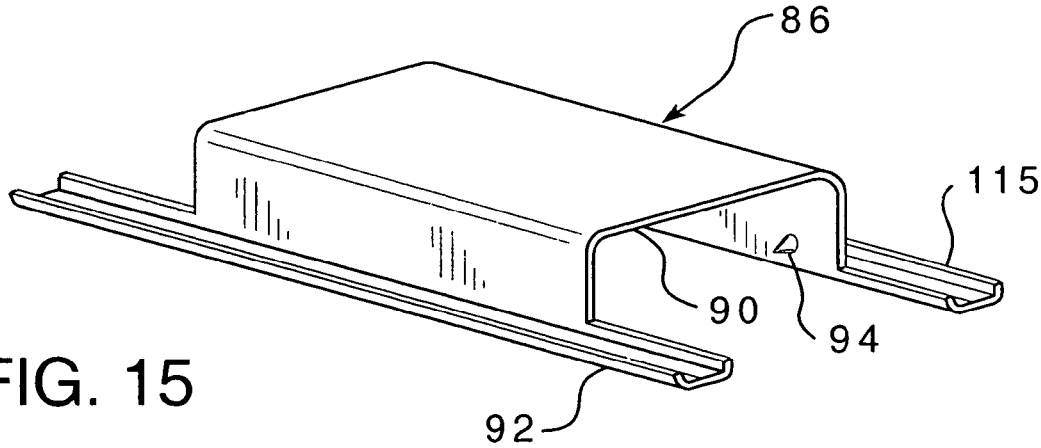
FIGS. 15 and 16 are isometric views of double and single adjustable supports, respectively, forming a part of a shelving system according to the present invention.
Figure 16:
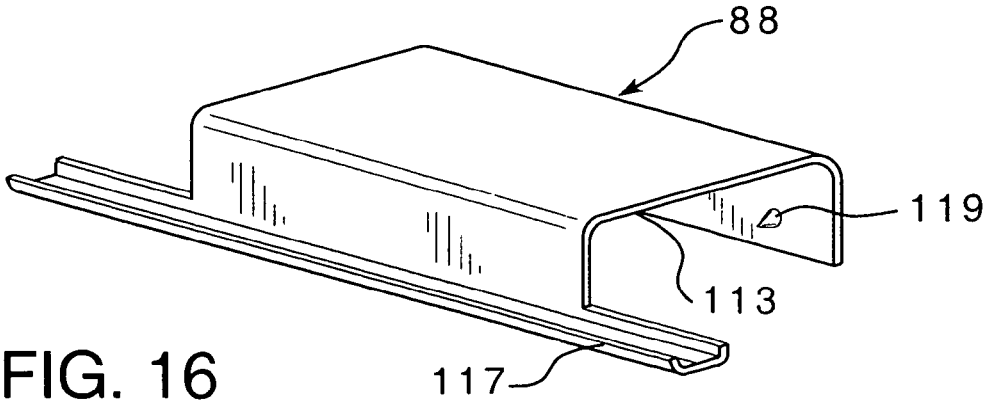
Figure 17:
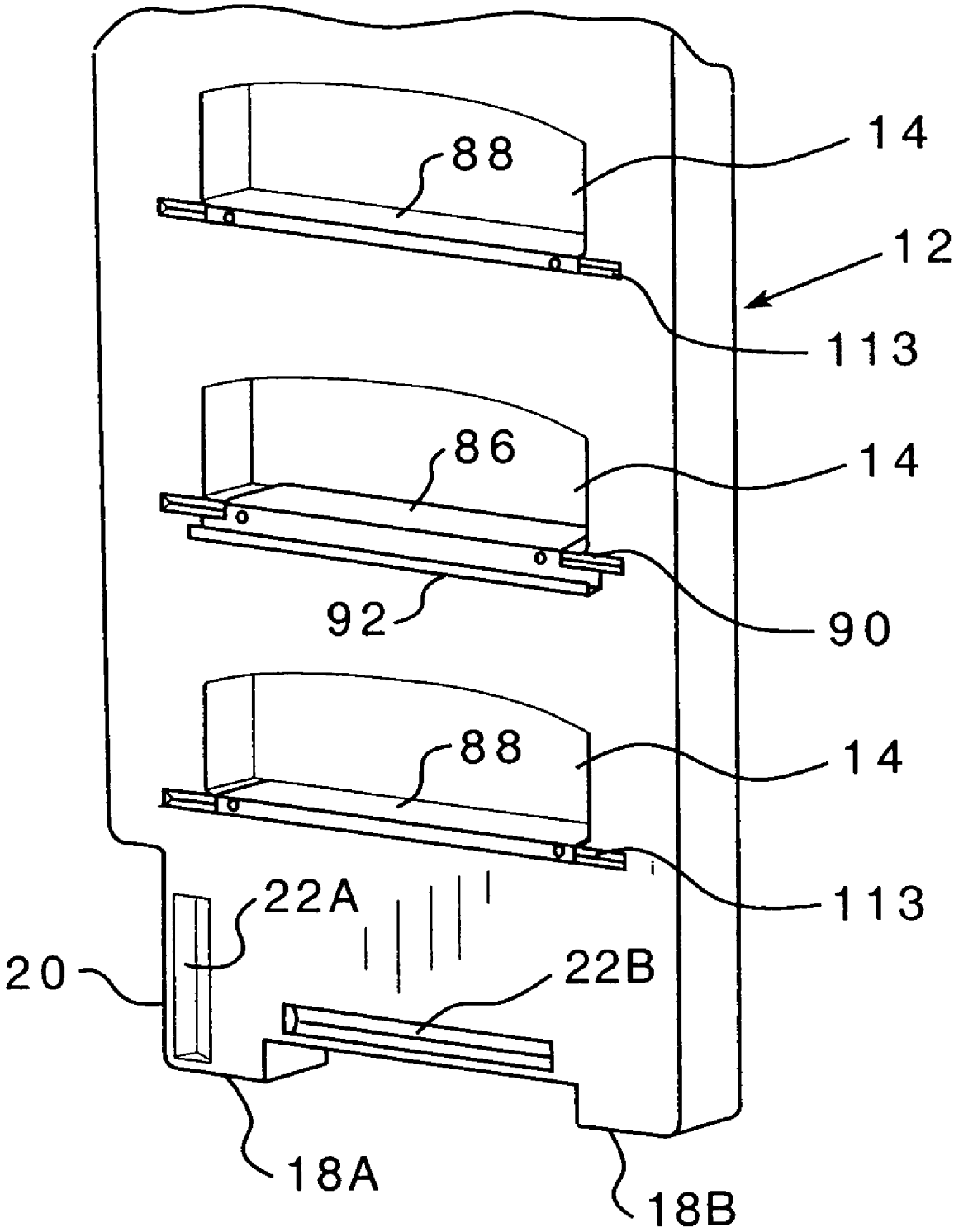
FIG. 17 is a partial isometric view showing the double and single adjustable supports shown in FIGS. 15 and 16 mounted on the lower column shown in FIG. 2A.

FIG. 15 is a perspective view of double adjustable support 86, and FIG. 16 is an isometric view of single adjustable support 88. Double adjustable support 86 and single adjustable support 88 are "adjustable" in that, as described below, they may be selectively placed between two mounting openings 14 of opposing lower columns 12 or upper columns 44. Double adjustable support 86 and single adjustable support 88 are preferably made of metal, such as stamped or roll formed steel, and are utilized to selectively attach adjustable shelf 66, corner adjustable shelf 72, and drawer 80 to lower columns 12 and upper columns 44. Specifically, double adjustable support 86 and single adjustable support 88 each include a central, generally concave receiving portion 90, 113 and either two longitudinally extending tongues 92 and 115 in the case of double adjustable support 86 or one longitudinally extending tongue 117 in the case of single adjustable support 86. As seen in FIG. 17, which is a partial isometric view of lower column 12, double adjustable support 86 and single adjustable support 88 may be selectively inserted through any of the mounting openings 14 of a lower column 12 or an upper column 44, with receiving portion 90 or 113 fitting over and receiving therein the portion of lower column 12 or upper column 44, as the case may be, that defines the bottom edge of the mounting opening 14.

Figure 18A:
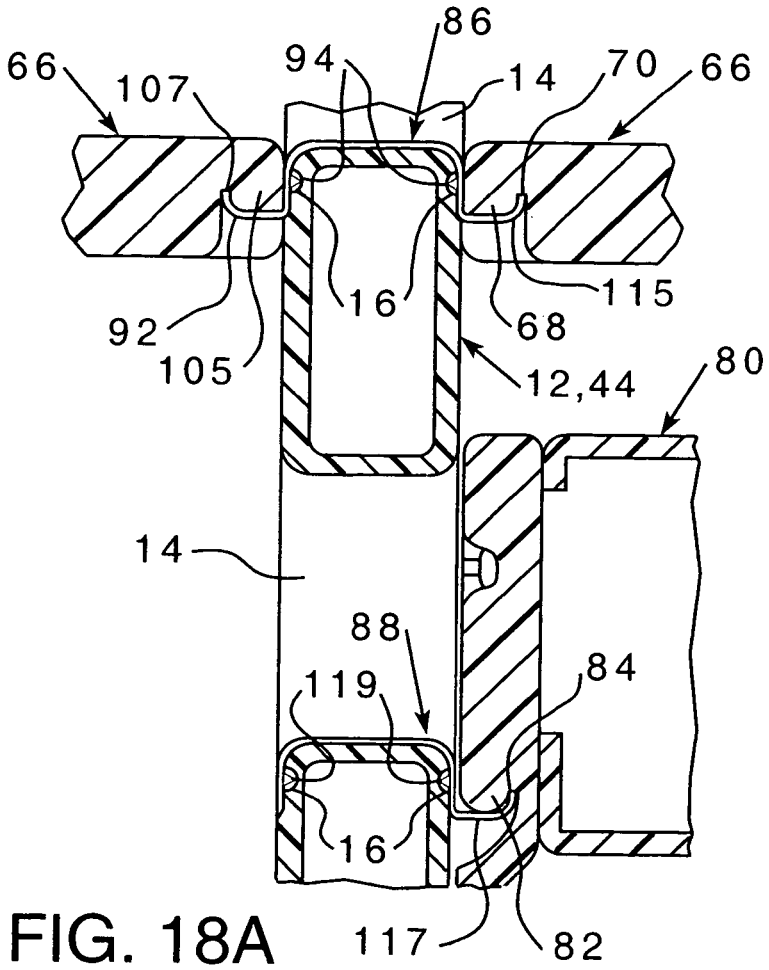
FIG. 18A is a cross sectional view of a portion of a shelving system according to the present invention showing a lower column of FIG. 2A or an upper column of FIG. 3A having a drawer and an adjustable shelf mounted thereon.
Figure 18B:
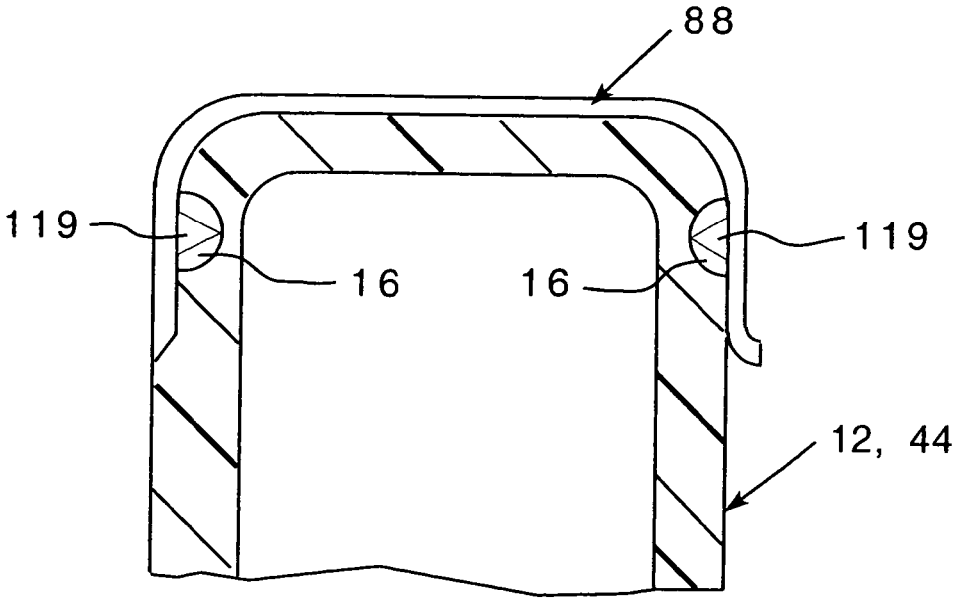
FIG. 18B is an enlarged view of a portion of the cross-section shown in FIG. 18A.

FIG. 18A is a cross sectional view of either a lower column 12 or an upper column 44 on which a double adjustable support 86 and a single adjustable support 88 have been attached, along with an adjustable shelf 66 and a drawer 80. As seen in FIG. 18A, adjustable shelf 66 and drawer 80 may be removeably attached to either a double adjustable support 86 or a single adjustable support 88 by inserting the tongues 92, 115 or 117 thereof into a respective groove 70 or 107 of adjustable shelf 66 or groove 84 of drawer 80. In the case of a drawer 80, once so attached, the tongues 92, 115 or 117 are free to slide within grooves 84 such that drawer 80 may be slid in and out of place in order to place items in and remove items from drawer 80. As seen in FIG. 18A and in an enlarged fashion in FIG. 18B, double adjustable support 86 and single adjustable support 88 each include one or more outwardly extending barbs 94 and 119 (preferably forming by stamping) that are adapted to be received in indentations 16 provided in lower columns 12 and upper columns 44 to both hold double adjustable support 86 and single adjustable support 88 in place and, preferably, to provide an audible snapping sound to the user to indicate that they have been correctly and securely attached.

Figure 19:
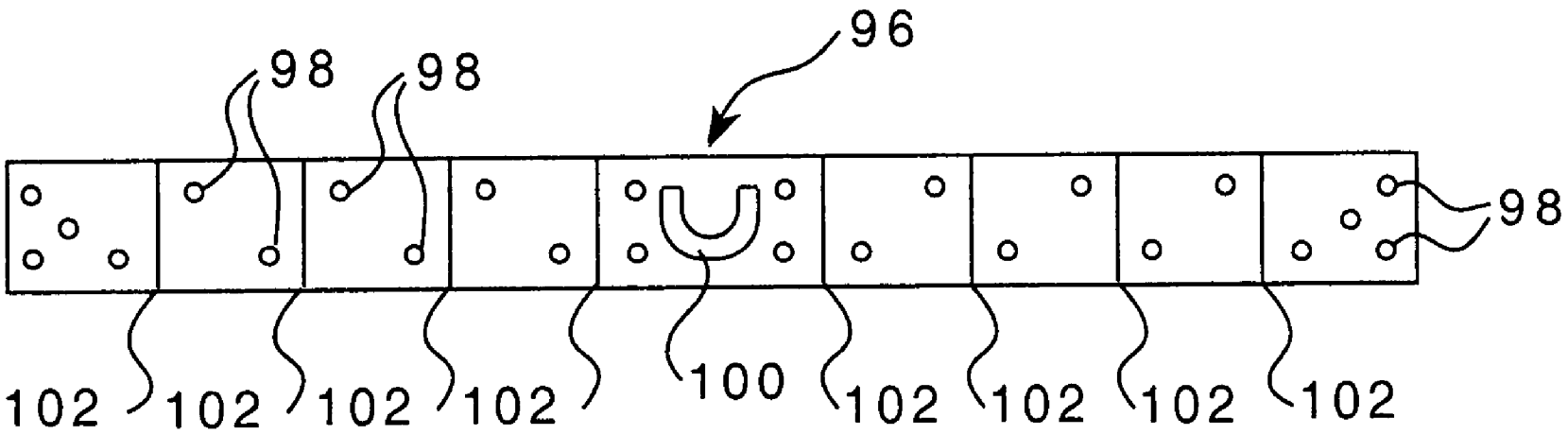
FIG. 19 is a front elevational view of a wall plate forming a part of a shelving system according to the present invention.

Finally, FIG. 19 is a front elevational view of wall plate 96. Wall plate 96 may be mounted on a building wall at a location that is adjacent to a last lower column 12 or upper column 44 forming a part of shelving assembly 10. As will be appreciated, one side of such a last lower column 12 or upper column 44 will not have an opposing lower column 12 or upper column 44, and wall plate 96 may be utilized when it is desired to have a rod 38 extend from such a side of a last lower column 12 or upper column 44. For example, such a last lower column 12 may be lower column 12A shown in FIG. 1. Wall plate 96 is provided to receive and hold one end of a rod 38 with the other end being held in the rod pocket 34A, 34B, 34C or 34D of the last lower column 12 or upper column 44. Wall plate 96 includes a plurality of apertures 98 for receiving therethrough a screw or the like for mounting wall plate 96 to a building wall, and rod slot 100 for receiving and holding the flared end 36 of a rod 38. In addition, wall plate 96 is provided in a number of sections that may be selectively broken off and detached by a user at lines 102 in order to allow a user to customize the size of wall plate 96.

Thus, as will be appreciated from the above description, the various pieces forming shelving system 10 may be selectively chosen and assembled in multiple configurations that may be customized to suit the particular needs of the user. In addition, shelving system 10 may be easily assembled using almost no tools (screws or the like may be used to anchor lower column 12 to a wall or baseboard and wall plate 96 to a wall, if desired) in a short time. Furthermore, shelving system 10 may be quickly and easily disassembled and reassembled in a different configuration as the needs of the user change.

While specific embodiments of the invention have been described in detail, it will be appreciated by those skilled in the art that various modifications and alternatives to those details could be developed in light of the overall teachings of the disclosure. Accordingly, the particular arrangements disclosed are meant to be illustrative only and not limiting as to the scope of the invention which is to be given the full breadth of the claims appended and any and all equivalents thereof.

What is claimed is:

1. A shelving system, comprising:

a vertical support column having an upper portion and a lower portion, said upper portion having one or more slots provided therein, said slots having a first shape;

a shelf, a first end of said shelf having one or more connectors protruding therefrom, said one or more connectors having an enlarged portion having a second shape, said first shape and said second shape being generally complementary to one another;

said enlarged portion of each of said one or more connectors being disposed in a respective one of said one or more slots, and a second vertical support column having an upper portion and a lower portion, said lower portion having one or more vertically extending tabs extending therefrom, said upper portion of said vertical support column having one or more vertically extending recesses provided therein, wherein at least one of said recesses is bounded by said first end of said shelf to define an intermediate slot between said shelf and said vertical support column, said vertical support column being a bottom vertical support column and said second vertical support column being a top vertical support column, each of said one or more tabs being disposed in a respective one of said one or more recesses such that at least one of said tabs is received within said slot.

2. A shelving system according to claim 1, including said one or more tabs being a first tab and a second tab, said one or more recesses being a first recess and a second recess, said first tab being disposed in said first recess and said second tab being disposed in said second recess.

3. A shelving system according to claim 1, including said lower portion of said vertical support column including an elongated vertical recess and an elongated horizontal recess each adapted to receive a fastening element, said elongated vertical recess having a first length and a first width, said first length being greater than said first width, said elongated horizontal recess having a second length and a second width, said second length being greater than said second width, wherein said first length is substantially perpendicular to said second length.

4. A shelving system, comprising:

a vertical support column having an upper portion and a lower portion, said upper portion having a first slot and a second slot provided therein, said first and second slots having a first shape;

a shelf, a first end of said shelf having a first connector and a second connector protruding therefrom, said first and second connectors each having an enlarged portion having a second shape, said first shape and said second shape being generally complementary to one another; and said enlarged portion of said first connector being disposed in said first slot and said enlarged portion of said second connector being disposed in said second slot, and said upper portion of said vertical support column having one or more detents, said first end of said shelf having one or more protruding tabs, said one or more protruding tabs being received and held in place by said one or more detents;

wherein an outermost edge of said vertical support column has a top edge, a bottom edge, a vertically extending left outer edge, a vertically extending right outer edge, and a recessed portion located between said upper portion and said lower portion, said recessed portion extending vertically from a first point below said top edge to a second point above said bottom edge and horizontally from said vertically extending left outer edge to said vertically extending right outer edge.

5. A shelving system according to claim 4, further comprising a second vertical support column having an upper portion having a third slot and a fourth slot provided therein, said third slot and said fourth slot having said first shape, said shelf having a second end opposite said first end, said second end having a third connector and a fourth connector protruding therefrom, said third connector and said fourth connector having an enlarged portion having said second shape, said third connector being disposed in said third slot and said fourth connector being disposed in said fourth slot.

6. A shelving system according to claim 4, including said one or more detents and said one or more protruding tabs producing a snapping sound when said one or more protruding tabs are received by said one or more detents.

7. A shelving system according to claim 4, including said upper portion of said vertical support column having a recess, said first end of said shelf having a protruding member, said protruding member being received by and supported on a bottom edge of said recess.

8. A shelving system according to claim 4, including said upper portion of said vertical support column having a horizontal support ledge extending therefrom, said first end of said shelf having a bottom edge, said bottom edge resting on and being supported by said support ledge.

9. A shelving system according to claim 4, including said lower portion of said vertical support column having a front foot and a back foot, said front foot being longer than said back foot.

* * * * *

UNITED STATES PATENT AND TRADEMARK OFFICE

CERTIFICATE OF CORRECTION

PATENT NO. : 7,686,173 B2
APPLICATION NO. : 11/048838
DATED : March 30, 2010
INVENTOR(S) : Larry Robinson et al.

It is certified that error appears in the above-identified patent and that said Letters Patent is hereby corrected as shown below:

Column 3, line 14, "removeably" should read --removably--.
Column 3, line 36, "removeably" should read --removably--.
Column 4, line 11, "in simple" should read --in a simple--.
Column 7, line 23, "can bee seen" should read --can be seen--.
Column 9, lines 17 and 18, "(e.g., front, back. And bottom with attached (by a living hinge) right and left sides)" should read --(e.g., front, back and bottom with attached (by a living hinge) right and left sides)--.
Column 9, line 49, "removeably" should read --removably--.

Signed and Sealed this

Seventh Day of September, 2010

David J. Kappos

David J. Kappos
*Director of the United States Patent and Trademark Office*